US011305899B2

(12) United States Patent
Liu et al.

(10) Patent No.: US 11,305,899 B2
(45) Date of Patent: Apr. 19, 2022

(54) PALLET STRAPPING DEVICE

(71) Applicants: TEKPAK CORPORATION, Taichung (TW); TRANSPAK EQUIPMENT CORPORATION, Taipei (TW)

(72) Inventors: Chin-Chang Liu, Taichung (TW); Chi-Jan Su, Taipei (TW)

(73) Assignees: TEKPAK CORPORATION, Taichung (TW); TRANSPAK EQUIPMENT CORPORATION, Taipei (TW)

( * ) Notice: Subject to any disclaimer, the term of this patent is extended or adjusted under 35 U.S.C. 154(b) by 196 days.

(21) Appl. No.: 15/930,380

(22) Filed: May 12, 2020

(65) Prior Publication Data

US 2021/0354862 A1 Nov. 18, 2021

(51) Int. Cl.
*B65B 13/14* (2006.01)

(52) U.S. Cl.
CPC ..... *B65B 13/14* (2013.01)

(58) Field of Classification Search
CPC ..... B65B 13/02; B65B 13/04; B65B 13/06; B65B 13/08; B65B 13/185; B65B 13/186; B65B 13/10; B65B 13/14
See application file for complete search history.

(56) References Cited

U.S. PATENT DOCUMENTS

| | | | | |
|---|---|---|---|---|
| 3,949,662 | A | 4/1976 | Woomer | |
| 6,073,425 | A * | 6/2000 | Chin-Chang | B65B 13/06 100/26 |
| 7,757,468 | B2 * | 7/2010 | Kastner | B65B 13/06 53/589 |
| 9,669,953 | B2 * | 6/2017 | Luo | B65B 13/32 |
| 9,745,090 | B2 * | 8/2017 | Haberstroh | B65B 13/32 |
| 11,040,789 | B2 * | 6/2021 | Vaughn | B65B 13/08 |

* cited by examiner

*Primary Examiner* — Matthew Katcoff
(74) *Attorney, Agent, or Firm* — Cheng-Ju Chiang

(57) ABSTRACT

The present invention is a pallet strapping device having a platform, a lower guiding strap portion, an upper guiding strap portion, a first frame portion, a second frame portion and a central guiding strap portion. By controlling a first guiding strap portion, a second guiding strap portion, and the central guiding strap portion that is moved to a retracted position, a first guiding strap circulation path can be formed. In addition, by controlling the first frame portion, the second frame portion and the central guiding strap portion that is moved to an extended position, a second guiding strap circulation path is formed. The present invention is capable of switching to different strapping paths corresponding to different pallets for strapping. Besides, it is quite convenient to conduct strapping tasks under the condition that the corresponding pallets is not needed to depart from the platform of the pallet strapping device.

6 Claims, 15 Drawing Sheets

PALLET STRAPPING DEVICE

BACKGROUND OF THE INVENTION

1. Field of the Invention

The present invention relates to a pallet strapping device, especially to a pallet strapping device which is capable of switching to different strapping paths corresponding to different pallets in order to proceed strapping on corresponding pallets, and capable of being rather convenient to switch to the different strapping paths without the corresponding pallets departing from a platform of the pallet strapping device.

2. The Related Arts

Well-known pallets are typically divided into two types. Referring to FIG. 9, the first type of pallets is a pallet 90 equipped with only a top plate 91. Referring to FIG. 10, the second type pallets is the pallet 90 equipped with the top plate 91 and a bottom plate 92.

For the first type of pallets 90, when a general strapping machine is used to proceed strapping on goods, a normal strapping can be performed to become a normal strapping form K1.

For the second type of pallets 90, when a general strapping machine is used to proceed strapping on goods, it is likely to strap under the bottom plate 92 in order to become an under-plate strapping form K2. At this time, a strapping machine having an extendable conducting strap portion is required to be used in order to penetrate into a space 93 between the top plate 91 and the bottom plate 92. Thus, strapping is performed by penetrating through the space 93 to become a penetrating strapping form K3.

Referring to FIG. 11, a conventional strapping machine 80 having an extendable conducting strap portion 85 (such as U.S. Pat. No. 3,949,662) includes a strap supply portion 81 for supplying a bundle of straps N, a conducting strap frame 82 and a conveying roller portion 83 for carrying a pallet 90. The pallet 90 has a top plate 91, a bottom plate 92, and a central space 93 located between the top plate 91 and the bottom plate 92 (refer to FIG. 10). A sliding rod assembly 84 has a sliding rod 841, a driving portion 842, a driving rod 843 and a sliding seat 844. The sliding seat 844 can slide horizontally on the sliding rod 841. Besides, the driving portion 842 can control a moving position of the sliding seat 844 through the driving rod 843. An extendable conducting strap portion 85 is disposed on the sliding seat 844. When the extendable conducting strap portion 85 moves into the central space 93, a closed path is formed by the extendable conducting strap portion 85 together with the conducting strap frame 82 in order to complete the desired strapping operation.

However, the conventional strapping machine 80 having an extendable conducting strap portion 85 can only perform a desired strapping operation in the penetrating strapping form K3. It cannot be switched to perform a desired strapping operation in the under-plate strapping form K2.

In view of the above, it is necessary to study and develop a technology that can solve the above-mentioned conventional shortcomings.

SUMMARY OF THE INVENTION

An object of the present invention is to provide a pallet strapping device which has advantages of being capable of switching to different strapping paths corresponding to different pallets in order to proceed strapping on corresponding pallets, and capable of being rather convenient to switch the different strapping paths without the corresponding pallets departing from a platform of the pallet strapping device, and so on. Particularly, problem to be solved by the present invention is generated from the following facts. Well-known pallets basically have two types. The first type of pallets is a pallet only equipped with a top plate, and the second type of pallets is a pallet equipped with the top plate and a bottom plate to form a central space therein. So far, no strapping device capable of switching ways to respectively strap the first and second types of pallets can be found.

In order to solve the above mentioned problem, a pallet strapping device is provided. The pallet strapping device comprises a platform, a first guiding device, a second guiding device and an extendable mechanism. The platform comprises a horizontal conveying portion, a vertical frame portion, a first pivot portion and a second pivot portion. The horizontal conveying portion comprises a plurality of horizontal rollers and a lower guiding strap portion. The vertical frame portion is equipped with an upper guiding strap portion.

The first guiding device comprises a first frame portion, a first guiding strap portion and a first driving portion. The first frame portion is pivotally disposed at the first pivot portion via one end of the first frame portion. The first guiding strap portion is disposed at the other end of the first frame portion. The first driving portion is pivotally disposed on the platform. The first driving portion connects the platform with the first frame portion. Besides, the first driving portion is used to control the first frame portion to be movable to at least a first position and a second position via taking the first pivot portion as an axis of the first frame portion. When the first frame portion is located at the first position, the first guiding strap portion is spatially communicated with the lower guiding strap portion and the upper guiding strap portion, respectively.

The second guiding device comprises a second frame portion, a second guiding strap portion and a second driving portion. The second frame portion is pivotally disposed at the second pivot portion via one end of the second frame portion. The second guiding strap portion is disposed at the other end of the second frame portion. The second driving portion is pivotally disposed on the platform. The second driving portion connects the platform with the second frame portion. Besides, the second driving portion is used to control the second frame portion to be movable to at least a third position and a fourth position via taking the second pivoting portion as an axis of the second frame portion. When the second frame portion is located at the third position, the second guiding strap portion is spatially communicated with the lower guiding strap portion and the upper guiding strap portion, respectively.

The extendable mechanism comprises a telescopic control portion and a central guiding strap portion. The telescopic control portion is used to control the central guiding strap portion to be movable to at least a retracted position and an extended position.

Accordingly, when the first frame portion is located at the first position, the second frame portion is located at the third position and the central guiding strap portion is located at the retracted position, the lower guiding strap portion, the upper guiding strap portion, the first guiding strap portion and the second guiding strap portion are spatially communicated with one another to form a first guiding strap circulation path. Besides, when the first frame portion is located at the second position, the second frame portion is located at the fourth position and the central guiding strap portion is located at the extended position, the upper guiding strap portion and the central guiding strap portion are spatially communicated with each other to form a second guiding strap circulation path.

The above mentioned objects and advantages of the present invention can be easily understood in details from the following preferred embodiments and attached drawings.

The present invention is described in details as follows via the following embodiments in cooperation with drawings.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENT

Figure 1:
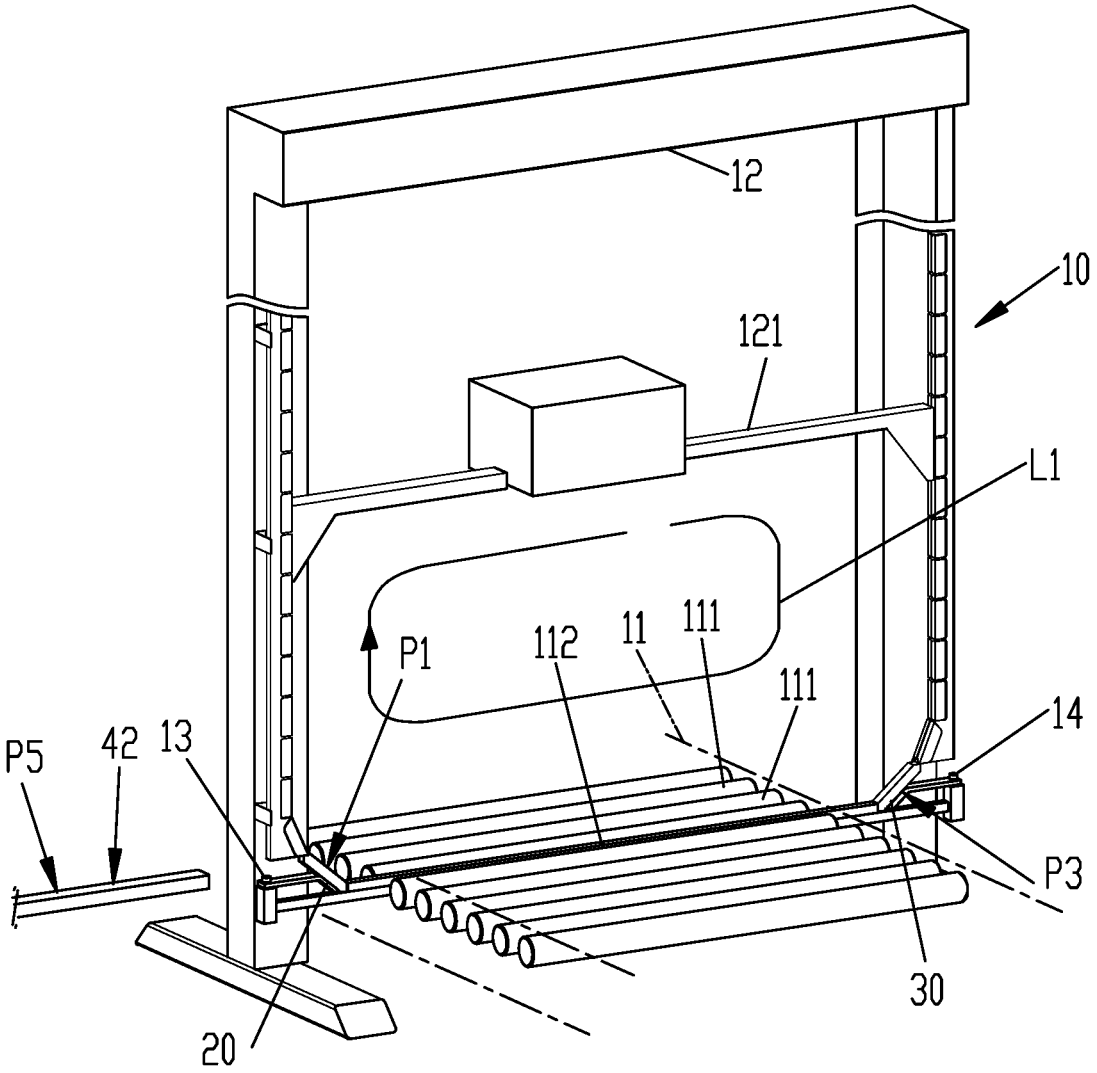
FIG. 1 is a schematic perspective view of a pallet strapping device in accordance with the present invention.

Referring to FIGS. 1, 2A, 2B, 3A, 3B, 5, 6, 7, 8A and 8B, the present invention is related to a pallet strapping device. The pallet strapping device comprises a platform 10, a first guiding device 20, a second guiding device 30 and an extendable mechanism 40.

The platform 10 comprises a horizontal conveying portion 11, a vertical frame portion 12, a first pivot portion 13 and a second pivot portion 14. The horizontal conveying portion 11 comprises a plurality of horizontal rollers 111 and a lower guiding strap portion 112. The vertical frame portion 12 is equipped with an upper guiding strap portion 121.

The first guiding device 20 comprises a first frame portion 21, a first guiding strap portion 22 and a first driving portion 23. The first frame portion 21 is pivotally disposed at the first pivot portion 13 via one end of the first frame portion 21. The first guiding strap portion 22 is disposed at the other end of the first frame portion 21. The first driving portion 23 is pivotally disposed on the platform 10. The first driving portion 23 connects the platform 10 with the first frame portion 21. Besides, the first driving portion 23 is used to control the first frame portion 21 to be movable to at least a first position P1 and a second position P2 via taking the first pivot portion 13 as an axis of the first frame portion 21. When the first frame portion 21 is located at the first position P1, the first guiding strap portion 22 is spatially communicated with the lower guiding strap portion 112 and the upper guiding strap portion 121, respectively.

The second guiding device 30 comprises a second frame portion 31, a second guiding strap portion 32 and a second driving portion 33. The second frame portion 31 is pivotally disposed at the second pivot portion 14 via one end of the second frame portion 31. The second guiding strap portion 32 is disposed at the other end of the second frame portion 31. The second driving portion 33 is pivotally disposed on the platform 10. The second driving portion 33 connects the platform 10 with the second frame portion 31. Besides, the second driving portion 33 is used to control the second frame portion 31 to be movable to at least a third position P3 and a fourth position P4 via taking the second pivoting portion 14 as an axis of the second frame portion 31. When the second frame portion 31 is located at the third position P3, the second guiding strap portion 32 is spatially communicated with the lower guiding strap portion 112 and the upper guiding strap portion 121, respectively.

The extendable mechanism 40 comprises a telescopic control portion 41 and a central guiding strap portion 42. The telescopic control portion 41 is used to control the central guiding strap portion 42 to be movable to at least a retracted position P5 and an extended position P6.

Figure 5:
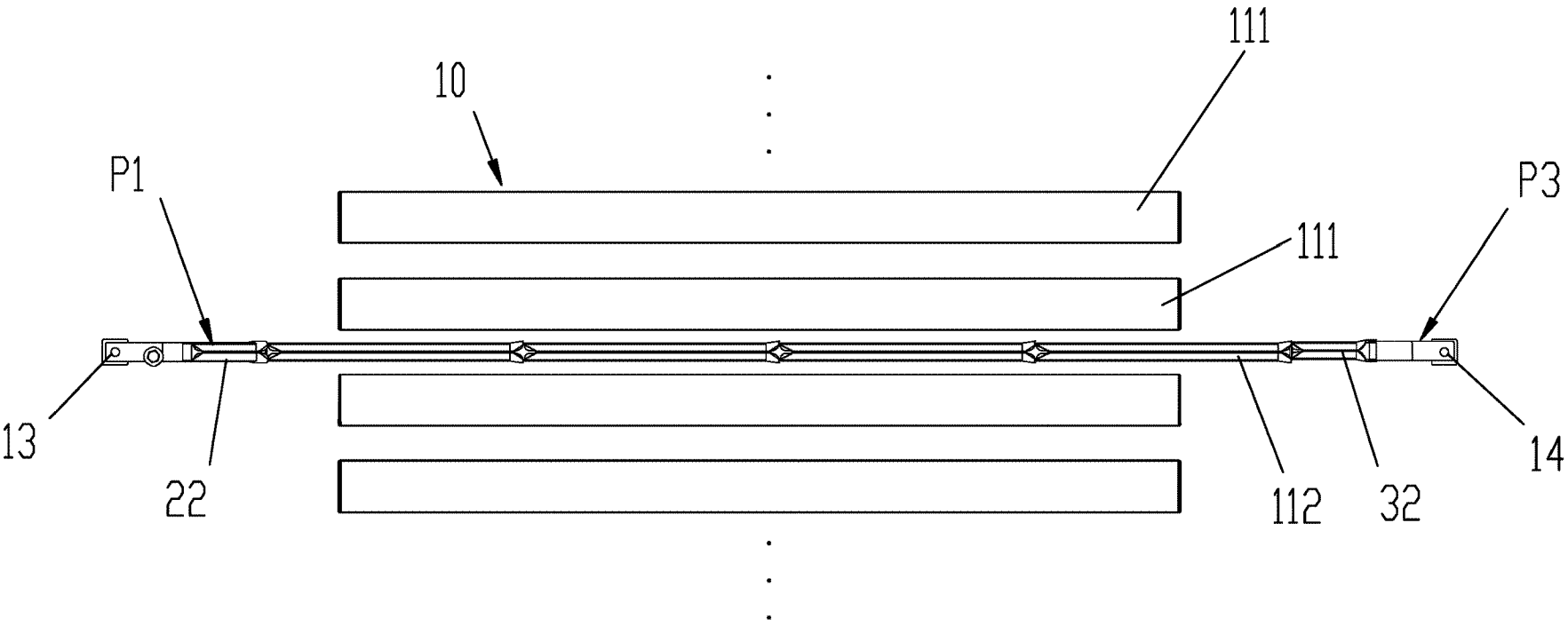
FIG. 5 is a schematic top plan view showing a first guiding strap portion and a second guiding strap portion of the pallet strapping device are respectively located in a first guiding strap circulation path in accordance with the present invention.
Figure 6:
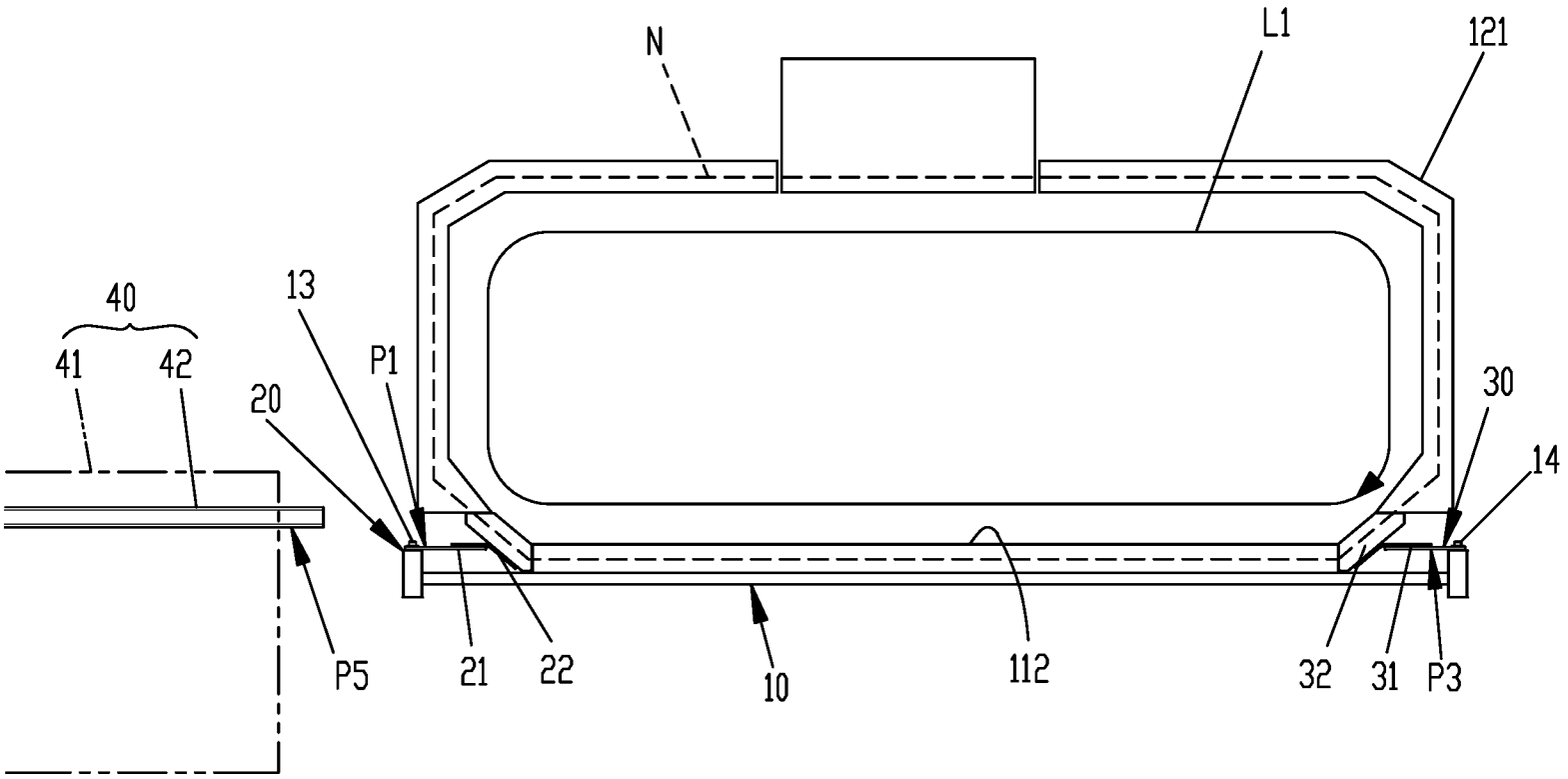
FIG. 6 is a schematic front side view showing the first guiding strap circulation path of the pallet strapping device in accordance with the present invention.
Figure 7:
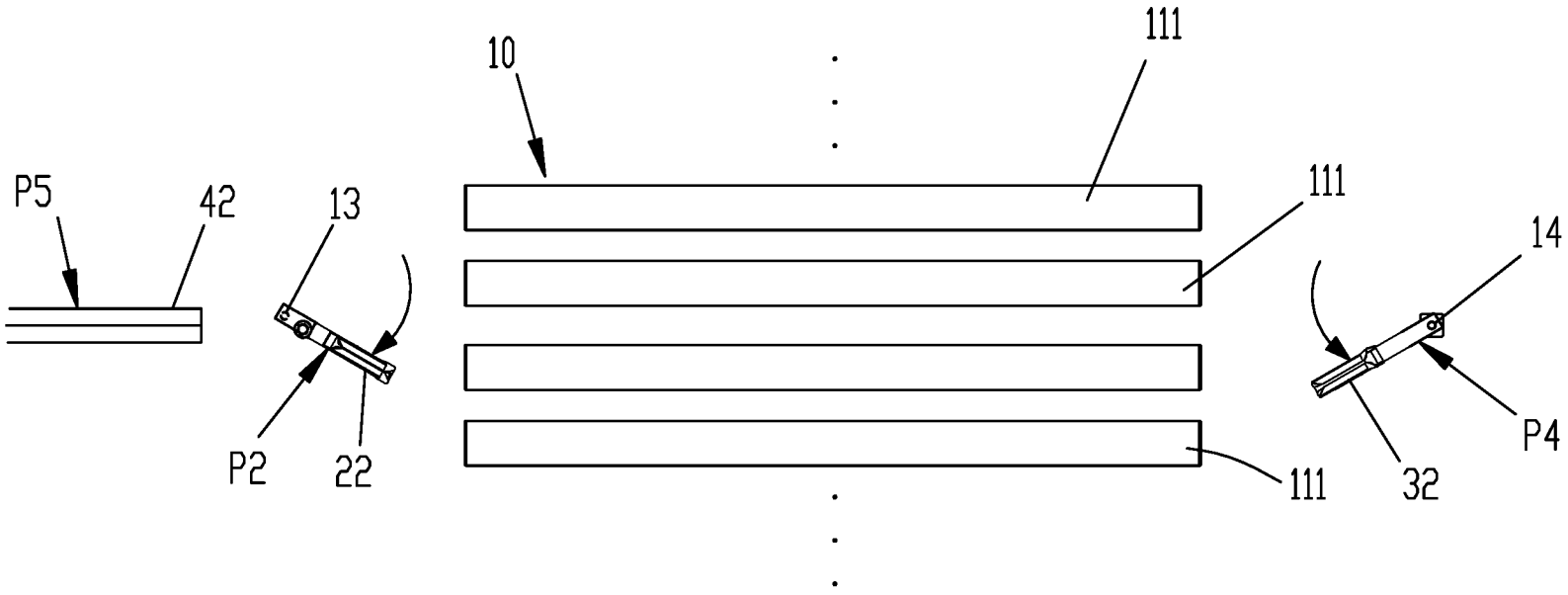
FIG. 7 is a schematic top plan view showing relationship between components of the pallet strapping device before switching to a second guiding strap circulation path in accordance with the present invention.
Figure 8A:
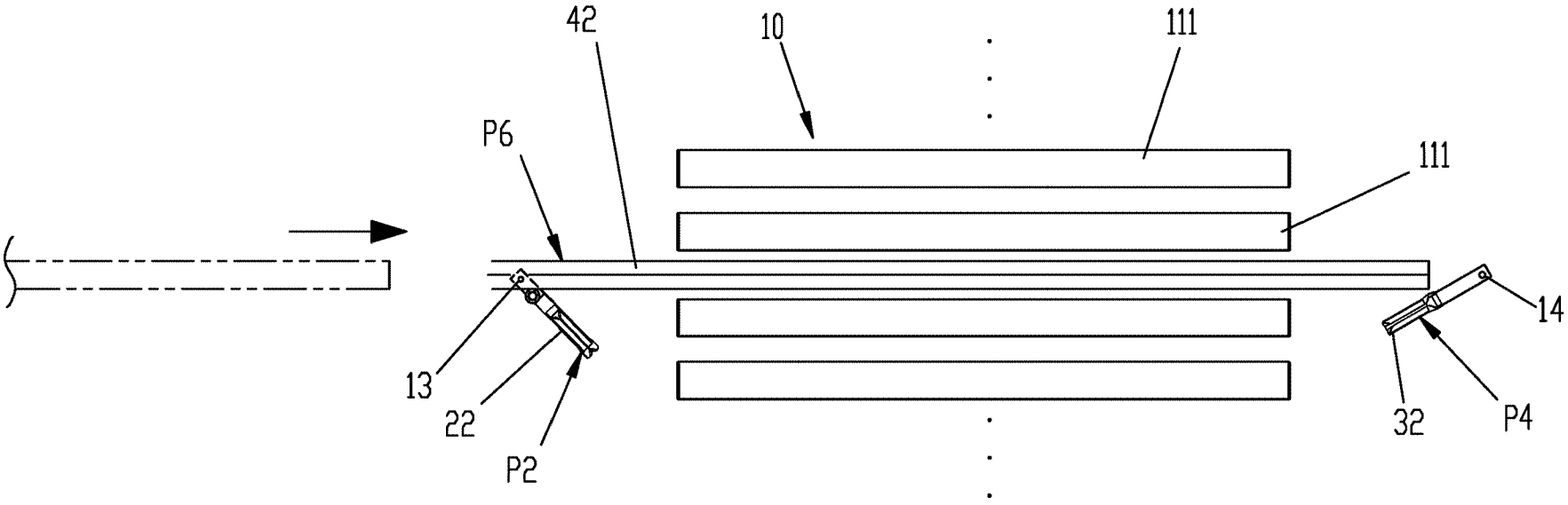
FIG. 8A is a schematic top plan view showing relationship between the components of the pallet strapping device after switching to the second guiding strap circulation path in accordance with the present invention.
Figure 8B:
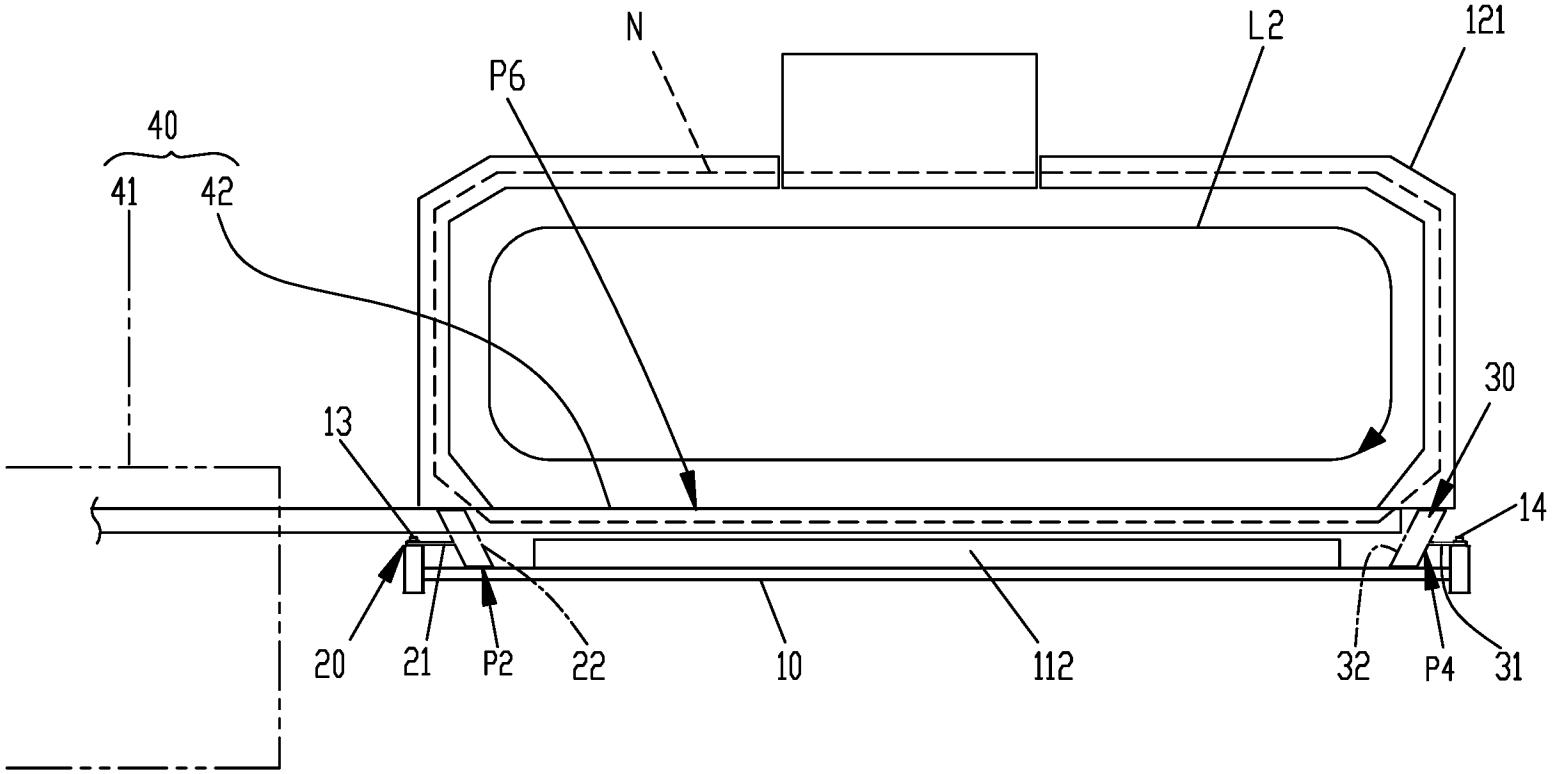
FIG. 8B is a schematic front side view showing the second guiding strap circulation path of the pallet strapping device in accordance with the present invention.

Accordingly, when the first frame portion 21 is located at the first position P1, the second frame portion 31 is located at the third position P3 and the central guiding strap portion 42 is located at the retracted position P5, the lower guiding strap portion 112, the upper guiding strap portion 121, the first guiding strap portion 22 and the second guiding strap portion 32 are spatially communicated with one another to form a first guiding strap circulation path L1 (as shown in FIGS. 5 and 6). Besides, when the first frame portion 21 is located at the second position P2, the second frame portion 31 is located at the fourth position P4 and the central guiding strap portion 42 is located at the extended position P6, the upper guiding strap portion 121 and the central guiding strap portion 42 are spatially communicated with each other to form a second guiding strap circulation path L2 (as shown in FIG. 8B).

In practice, when the first frame portion 21 is located at the second position P2, the first guiding strap portion 22 is used to stagger the lower guiding strap portion 112 and the upper guiding strap portion 121 from each other.

When the second frame portion 31 is located at the fourth position P4, the second guiding strap portion 32 is used to stagger the lower guiding strap portion 112 and the upper guiding strap portion 121 from each other.

The first driving portion 23 is preferred to be one of an electric gear cylinder, a pneumatic cylinder and a push-pull driving device.

Figure 2A:
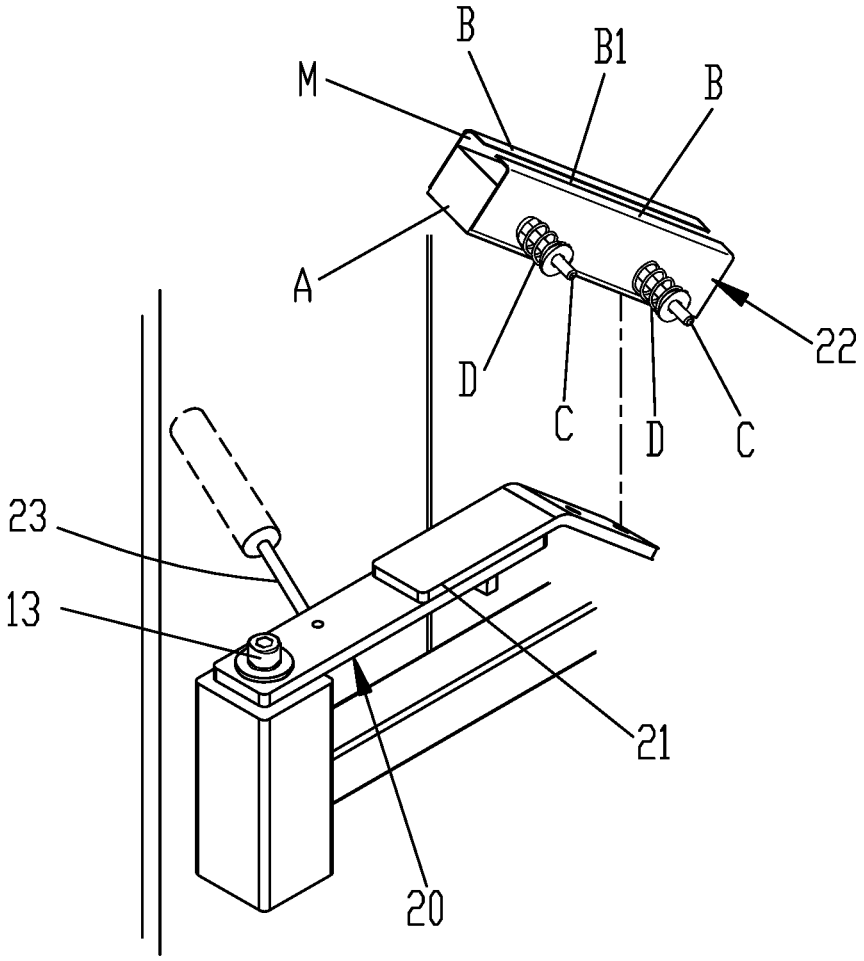
FIG. 2A is a schematic exploded perspective view of a first embodiment of a first guiding device of the pallet strapping device in accordance with the present invention.
Figure 2B:
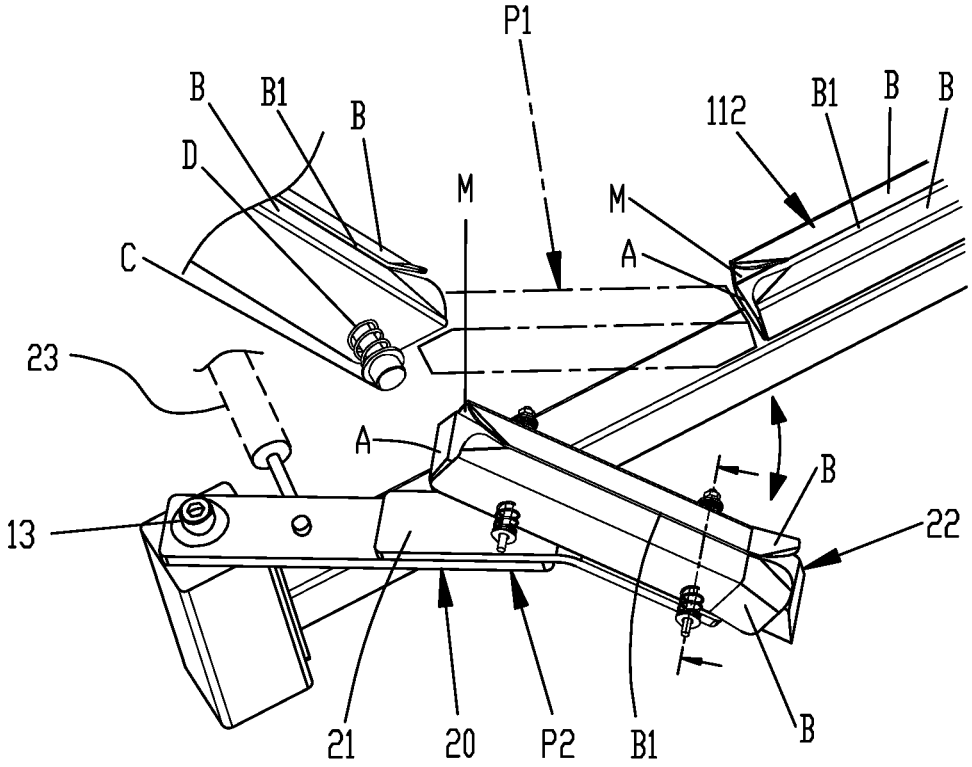
FIG. 2B is a schematic perspective view showing movements of the first guiding device of the pallet strapping device shown in FIG. 2A in accordance with the present invention.
Figure 2C:
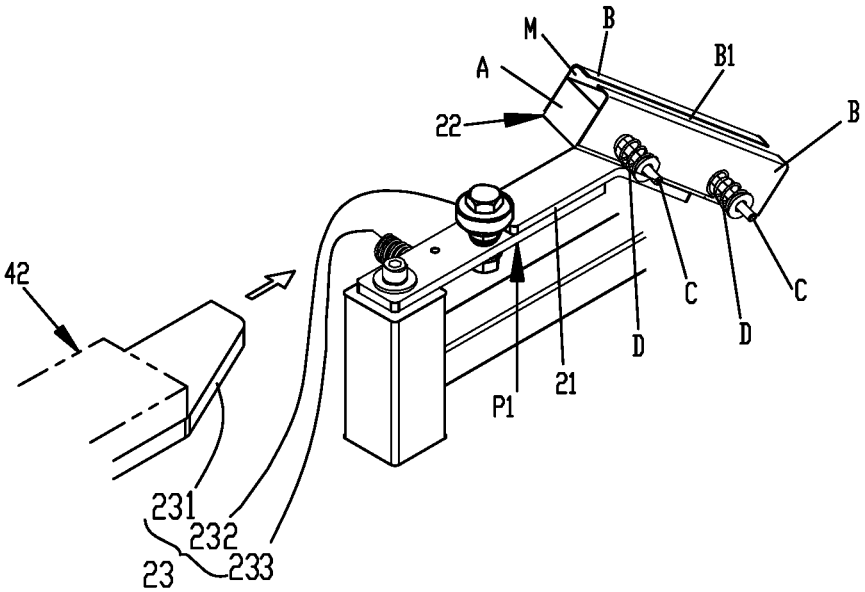
FIG. 2C is a schematic perspective view of a second embodiment of the first guiding device of the pallet strapping device before any movement in accordance with the present invention.
Figure 2D:
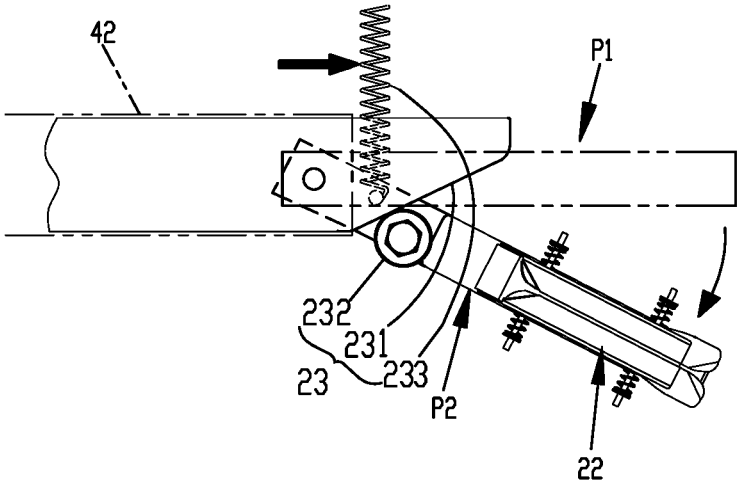
FIG. 2D is a schematic top plan view of the second embodiment of the first guiding device of the pallet strapping device after movements of the first guiding device in accordance with the present invention.
Figure 3A:
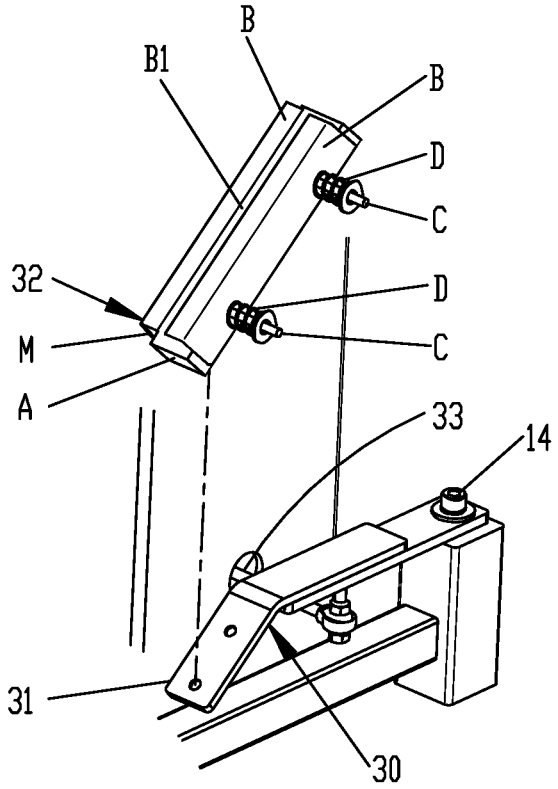
FIG. 3A is a schematic partially-exploded perspective view of a second guiding device of the pallet strapping device in accordance with the present invention.
Figure 3B:
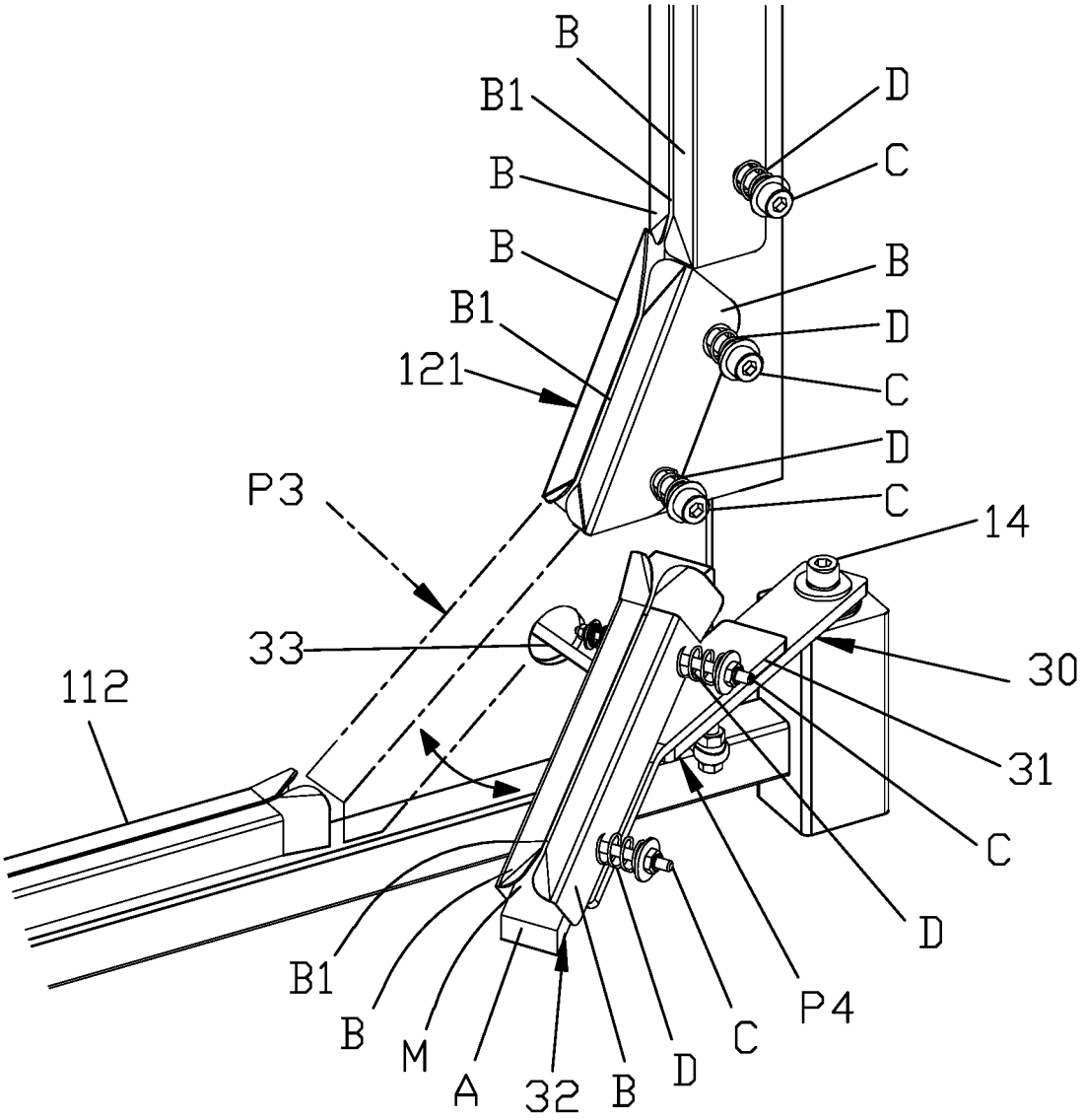
FIG. 3B is a schematic perspective view showing movements of the second guiding device of the pallet strapping device in accordance with the present invention.

Referring to FIGS. 2C and 2D, the push-pull driving device comprises an oblique push face portion 231, a pushed portion 232 and a restoring portion 233. The oblique push face portion 231 is connected to the central guiding strap portion 42 and is adjacent to an end of the central guiding strap portion 42 facing the platform 10. The pushed portion 232 is uprightly disposed at the first frame portion 21. The restoring portion 233 is connected with the platform 10 and the first frame portion 21, respectively.

Accordingly, during movement of the central guiding strap portion 42 from the retracted position P5 to the extended position P6, the oblique push face portion 231 simultaneously pushes the pushed portion 232. The pushed portion 232 is configured to connectively and simultaneously move the first frame portion 21 from the first position P1 to the second position P2, and the moved first frame portion 21 pulls the restoring portion 233 to move at the same time.

During movement of the central guiding strap portion 42 from the extended position P6 to the retracted position P5, the oblique push face portion 231 is simultaneously withdrawn away from the pushed portion 232. The restoring portion 233 generates a pulling force to pull the first frame portion 21, and the first frame portion 21 is restored to move from the second position P2 to the first position P1.

The restoring portion 233 may be an expansion spring.

The second driving portion 33 may be one of an electric gear cylinder and a pneumatic cylinder.

Figure 4:
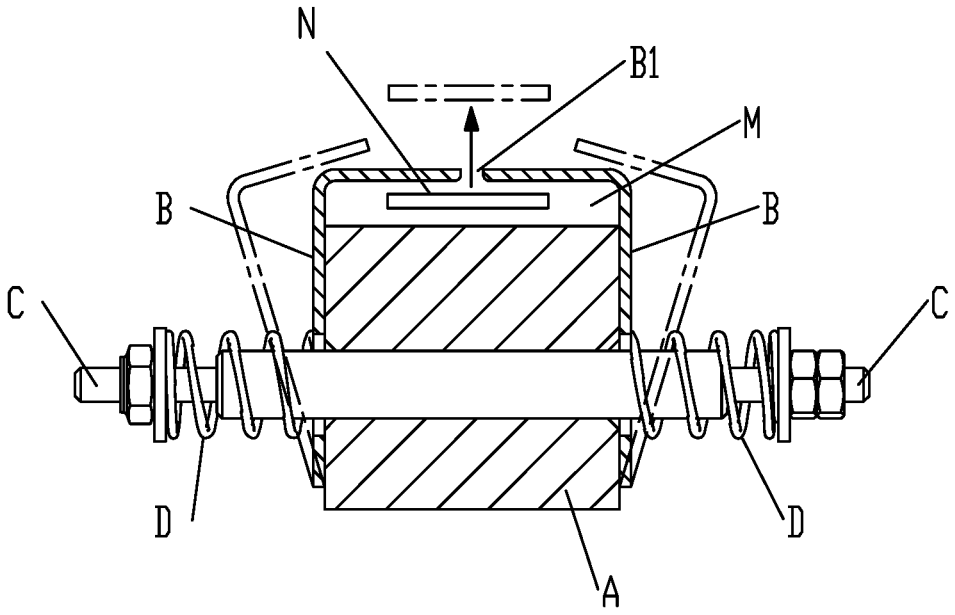
FIG. 4 is a schematic cross-sectional view showing movements of guiding straps for the pallet strapping device in accordance with the present invention.

Furthermore, referring to FIG. 4, all of the lower guiding strap portion 112, the upper guiding strap portion 121, the first guiding strap portion 22, the second guiding strap portion 32 and the central guiding strap portion 42 comprise a guiding strap bottom plate A, a pair of L-shaped protective plates B, at least one pair of extension bolts C and at least one pair of elastic members D.

The at least one pair of extension bolts C are used to respectively fix corresponding ones of the pair of L-shaped protective plates B onto two opposite sides of the guiding strap bottom plate A. An opening B1 is formed between the pair of L-shaped protective plates B fixed onto the guiding strap bottom plate A. The at least one pair of elastic members D are disposed to respectively sleeve around corresponding ones of the at least one pair of extension bolts C in order to respectively abut against the corresponding ones of the pair of L-shaped protective plates B by pushing forces.

Accordingly, an accommodating space M is formed between the pair of L-shaped protective plates B and the guiding strap bottom plate A. The accommodating space M communicates with the opening B1 and allows a bundle of straps N disposed to pass therethrough. The bundle of strap N is able to stretch the opening B1 by forcing the pair of L-shaped protective plates B to move away from each other, and is able to enter and exit the accommodating space M via the opening B1.

Figure 9:
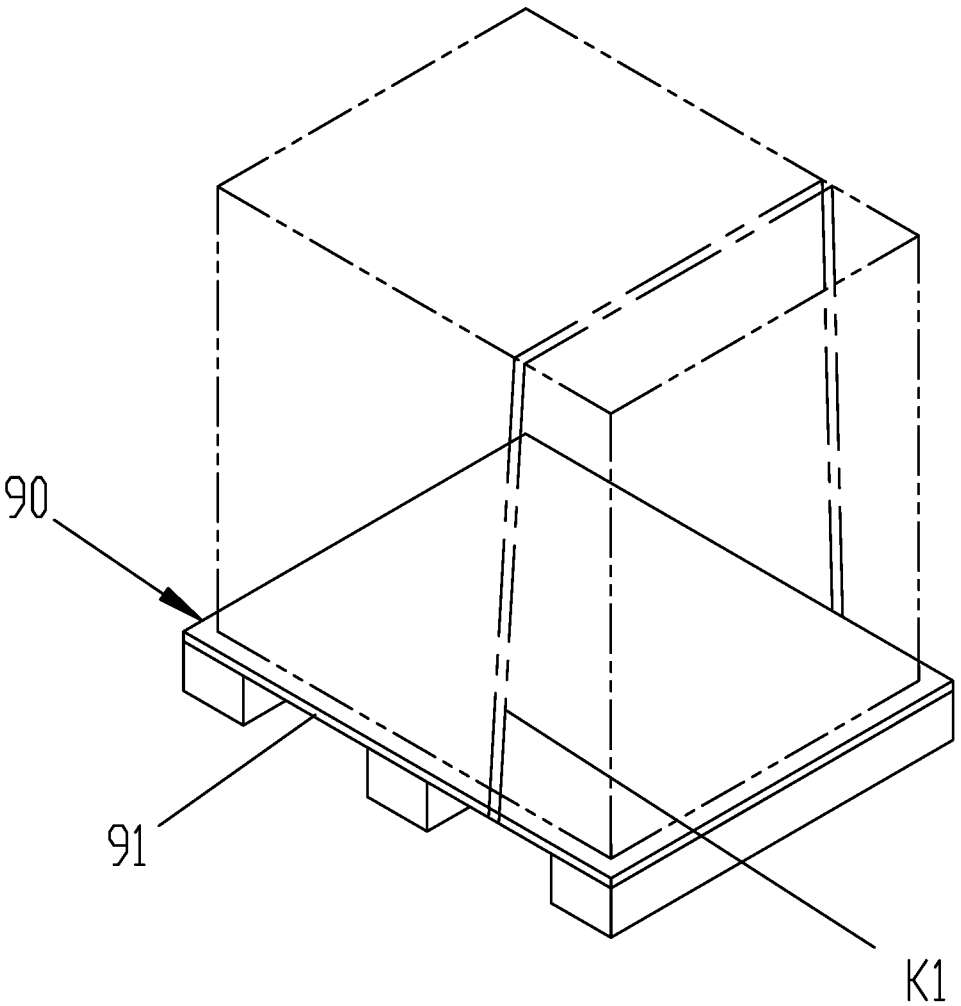
FIG. 9 (Prior Art)
FIG. 9 is a schematic perspective view showing a first strapping type on well-known pallets.
Figure 10:
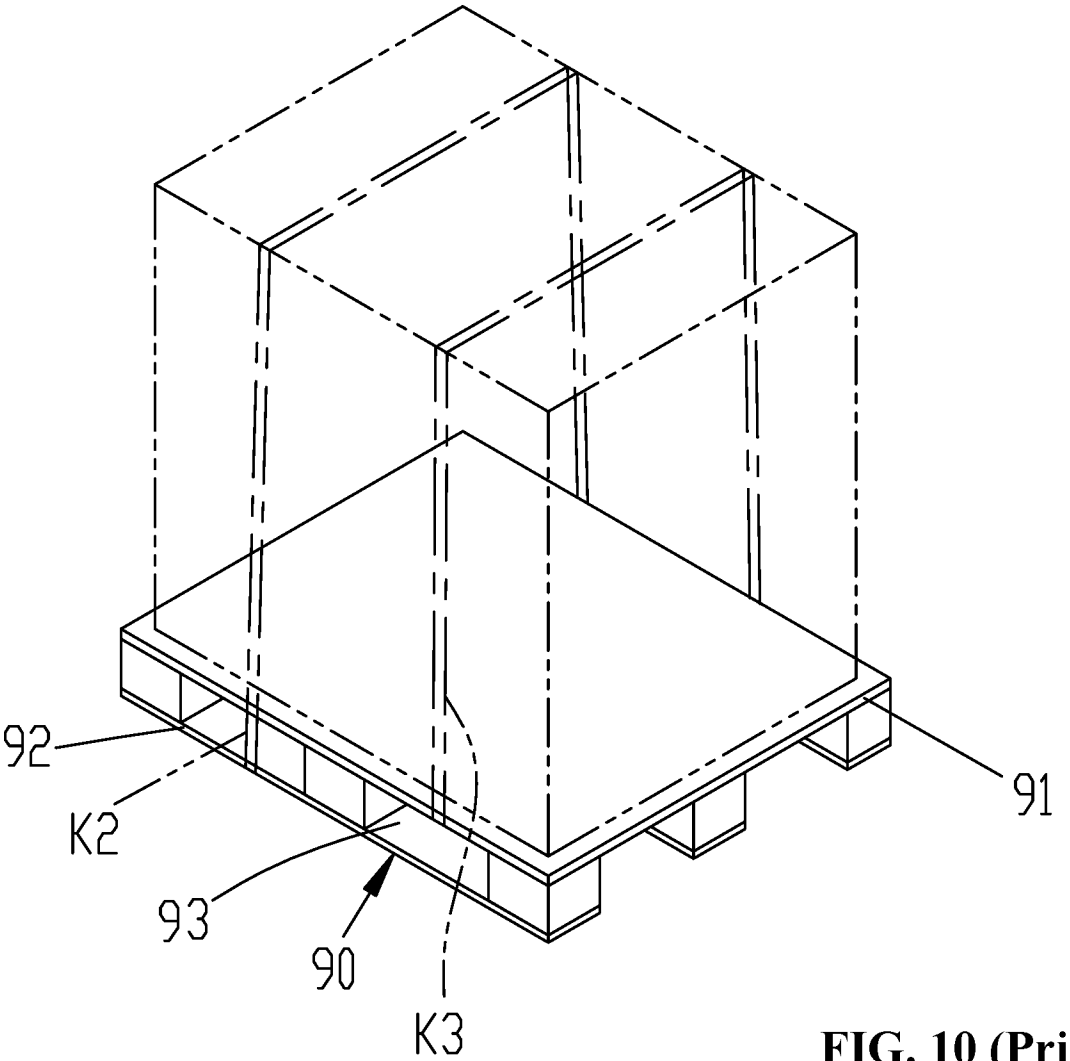
FIG. 10 (Prior Art)
FIG. 10 is a schematic perspective view showing a second strapping type and a third strapping type on well-known pallets.
Figure 11:
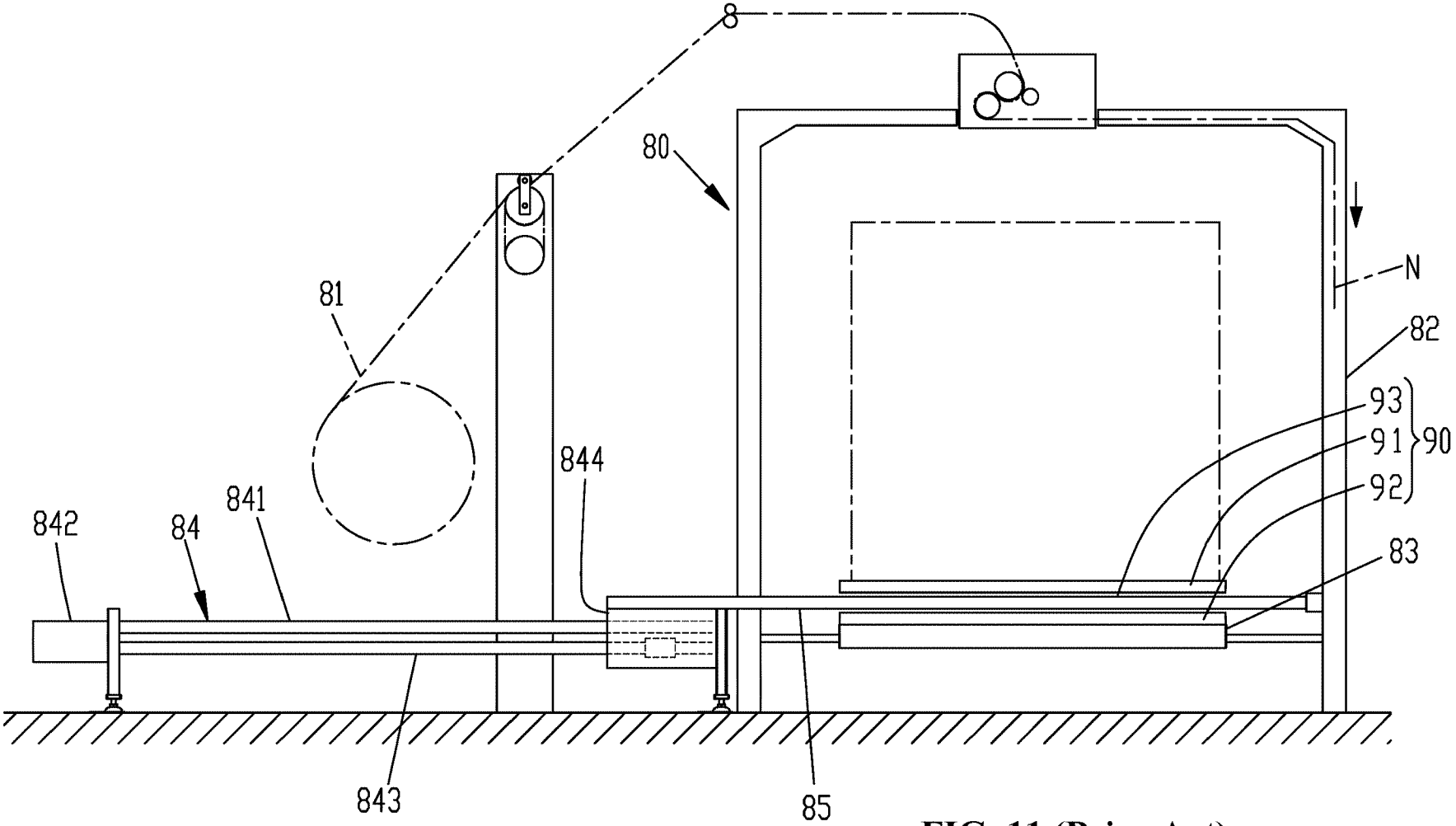
FIG. 11 (Prior Art)
FIG. 11 is a schematic front side view showing a strapping equipment for the third strapping type shown in FIG. 10.

It is well known in the industry that there are basically two types of pallets. The first type of pallets is a pallet 90 only equipped with a top plate 91 (referring to FIG. 9), and the second type of pallets is the pallet 90 equipped with the top plate 91 and a bottom plate 92 (referring to FIG. 10).

When the first type of pallets 90 is about to be strapped, the first frame portion 21 is located at the first position P1, the second frame portion 31 is located at the third position P3 and the central guiding strap portion 42 is located at the retracted position P5. The lower guiding strap portion 112, the upper guiding strap portion 121, the first guiding strap portion 22 and the second guiding strap portion 32 are spatially communicated with one another to form the first guiding strap circulation path L1 (as shown in FIGS. 5-6). the first type of pallets 90 can therefore be strapped.

When the second type of pallets 90 is about to be strapped, the first frame portion 21 is located at the second position P2, the second frame portion 31 is located at the fourth position P4 and the central guiding strap portion 42 is located at the extended position P6. The upper guiding strap portion 121 and the central guiding strap portion 42 are spatially communicated with each other to form the second guiding strap circulation path L2 (as shown in FIG. 8B). The central guiding strap portion 42 extends to be located at the extended position P6 between the top plate 91 and the bottom plates 92 of the second type of pallets 90, and the second type of pallets 90 can therefore be strapped.

Advantages and effects of the present invention are described as follows.

[1] Capability of switching different strapping paths corresponding to different pallets. The pallet strapping device of the present invention is capable of switching to the first guiding strap circulation path L1 and the second guiding strap circulation path L2 corresponding to the first type of pallets 90 only equipped with the top plate 91 and the second type of pallets 90 equipped with the top plate 91 and the bottom plate 92, respectively, and is capable of directly strapping either one of the first and second types of pallets without any delay. Therefore, the pallet strapping device of the present invention is capable of switching different strapping paths corresponding to different pallets.

[2] Significant convenience of switching paths without requirement of pallets departing from the platform 10. Only the first pivot portion 13 and the second pivot portion 14 of the pallet strapping device of the present invention are required to be installed on the platform 10, and the first guiding strap portion 22 and the second guiding strap portion 32 are correspondingly disposed. Additionally, the extendable mechanism 40 is coordinately disposed. Accordingly, path switching can be directly proceeded without requirement of pallets departing from the platform 10. Hence, different types of pallets can be mingled together for strapping processes designated in the same strapping proceeding, and such arrangement is rather convenient. As a result, it is rather convenient to switch strapping paths without requirement of pallets departing from the platform 10.

The above disclosure of preferred embodiment of the present invention is only used to describe and explain the present invention in details. Simple modifications and changes made to the preferred embodiment are deemed to be covered by the following claims of the present invention without departing from spirit and scope of the present invention.

What is claimed is:

1. A pallet strapping device, comprising:

a platform comprising a horizontal conveying portion, a vertical frame portion, a first pivot portion and a second pivot portion, the horizontal conveying portion comprising a plurality of horizontal rollers and a lower guiding strap portion, the vertical frame portion equipped with an upper guiding strap portion;

a first guiding device comprising a first frame portion, a first guiding strap portion and a first driving portion, the first frame portion pivotally disposed at the first pivot portion via one end of the first frame portion, the first guiding strap portion disposed at the other end of the first frame portion, the first driving portion pivotally disposed on the platform, and the first driving portion connecting the platform with the first frame portion, the first driving portion used to control the first frame portion to be movable to at least a first position and a second position via taking the first pivot portion as an axis of the first frame portion, wherein when the first frame portion is located at the first position, the first guiding strap portion is spatially communicated with the lower guiding strap portion and the upper guiding strap portion, respectively;

a second guiding device comprising a second frame portion, a second guiding strap portion and a second driving portion, the second frame portion pivotally disposed at the second pivot portion via one end of the second frame portion, the second guiding strap portion disposed at the other end of the second frame portion, the second driving portion pivotally disposed on the platform, and the second driving portion connecting the platform with the second frame portion, the second driving portion used to control the second frame portion to be movable to at least a third position and a fourth position via taking the second pivoting portion as an axis of the second frame portion, wherein when the second frame portion is located at the third position, the second guiding strap portion is spatially communicated with the lower guiding strap portion and the upper guiding strap portion, respectively; and an extendable mechanism comprising a telescopic control portion and a central guiding strap portion, the telescopic control portion used to control the central guiding strap portion to be movable to at least a retracted position and an extended position;

wherein when the first frame portion is located at the first position, the second frame portion is located at the third position and the central guiding strap portion is located at the retracted position, the lower guiding strap portion, the upper guiding strap portion, the first guiding strap portion and the second guiding strap portion are spatially communicated with one another to form a first guiding strap circulation path; when the first frame portion is located at the second position, the second frame portion is located at the fourth position and the central guiding strap portion is located at the extended position, the upper guiding strap portion and the central guiding strap portion are spatially communicated with each other to form a second guiding strap circulation path.

2. The pallet strapping device as claimed in claim 1, wherein:

when the first frame portion is located at the second position, the first guiding strap portion is used to stagger the lower guiding strap portion and the upper guiding strap portion from each other; and when the second frame portion is located at the fourth position, the second guiding strap portion is used to stagger the lower guiding strap portion and the upper guiding strap portion from each other.

3. The pallet strapping device as claimed in claim 1, wherein:

the first driving portion is one of an electric gear cylinder, a pneumatic cylinder and a push-pull driving device.

4. The pallet strapping device as claimed in claim 3, wherein:

when the first driving portion is the push-pull driving device, the push-pull driving device comprises an oblique push face portion, a pushed portion and a restoring portion, the oblique push face portion is connected to the central guiding strap portion and is adjacent to an end of the central guiding strap portion facing the platform, the pushed portion is uprightly disposed at the first frame portion, the restoring portion is connected with the platform and the first frame portion, respectively;

during movement of the central guiding strap portion from the retracted position to the extended position, the oblique push face portion simultaneously pushes the pushed portion, the pushed portion is configured to connectively and simultaneously move the first frame portion from the first position to the second position, and the moved first frame portion pulls the restoring portion to move at the same time; and during movement of the central guiding strap portion from the extended position to the retracted position, the oblique push face portion is simultaneously withdrawn away from the pushed portion, the restoring portion generates a pulling force to pull the first frame portion, and the first frame portion is restored to move from the second position to the first position.

5. The pallet strapping device as claimed in claim 4, wherein the restoring portion is an expansion spring.

6. The pallet strapping device as claimed in claim 1, wherein the second driving portion is one of an electric gear cylinder and a pneumatic cylinder.

* * * * *